US007695571B2

(12) United States Patent
Purtilo et al.

(10) Patent No.: US 7,695,571 B2
(45) Date of Patent: Apr. 13, 2010

(54) WASH/RINSE SYSTEM FOR A DRAWER-TYPE DISHWASHER

(75) Inventors: Dennis J. Purtilo, Newton, IA (US); Timothy P. Schwartz, Buford, GA (US); Thomas J. Wuestefeld, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 549 days.

(21) Appl. No.: 11/500,997

(22) Filed: Aug. 9, 2006

(65) Prior Publication Data

US 2007/0246078 A1 Oct. 25, 2007

Related U.S. Application Data

(60) Provisional application No. 60/793,245, filed on Apr. 20, 2006.

(51) Int. Cl.
*B08B 3/00* (2006.01)
*A47L 15/42* (2006.01)
*B05B 1/26* (2006.01)

(52) U.S. Cl. ..... 134/56 D; 134/57 D; 134/58 D; 239/498; 239/159

(58) Field of Classification Search ..... 134/56 D, 134/56 E, 57 D, 57 R, 58 D, 58 R, 172, 198, 134/18, 25.2, 34; 222/490, 251, 526, 565, 222/566, 567; 239/97, 98, 214, 214.13, 214.19, 239/222.11, 222.17, 225.1, 230, 231, 498, 239/499, 500, 501, 505, 507, 508
See application file for complete search history.

(56) References Cited

U.S. PATENT DOCUMENTS 1,477,903 A 12/1923 Rosenbaum
1,679,062 A * 7/1928 Smith ..... 134/183
1,916,806 A 7/1933 Myrick
2,436,169 A * 2/1948 Haberstump ..... 239/220

(Continued)

FOREIGN PATENT DOCUMENTS

EP 0282239 A2 9/1988

(Continued)

OTHER PUBLICATIONS

American Heritage Dictionary (Diffuser).*

*Primary Examiner*—Michael Kornakov
*Assistant Examiner*—Stephen Ko
(74) *Attorney, Agent, or Firm*—John W. Morrison; Diederiks & Whitelaw PLC

(57) ABSTRACT

A wash/rinse system for a drawer-type dishwasher includes a wash mechanism having a paddlewheel and a spray bar mounted in a washing chamber of the dishwasher. The spray bar includes at least one nozzle that is positioned so as to deliver a jet of washing fluid onto a deflector member provided on the paddlewheel. Upon impacting the deflector member, the jet of washing fluid diverges into streams of washing fluid which are sprayed onto articles positioned in the washing chamber. Preferably, the spray bar includes a plurality of nozzles which direct multiple jets of washing fluid onto a corresponding plurality of deflector members. The paddlewheel is mounted so as to create random streams of washing fluid that are sprayed into the washing chamber to combine with washing fluid emanating from a lower wash arm to clean articles in the washing chamber.

19 Claims, 8 Drawing Sheets

U.S. PATENT DOCUMENTS

| | | | | | |
|---|---|---|---|---|---|
| 2,586,398 | A | | 2/1952 | Vars | |
| 2,614,886 | A | | 10/1952 | Dewdney | |
| 2,657,095 | A | * | 10/1953 | James et al. | 239/220 |
| 2,704,084 | A | * | 3/1955 | James et al. | 134/183 |
| 2,905,092 | A | | 9/1959 | Abresch | |
| 3,051,182 | A | * | 8/1962 | Gibson | 134/108 |
| 3,095,885 | A | | 7/1963 | Hertell | |
| 3,207,167 | A | | 9/1965 | Edstrom | |
| 3,288,154 | A | | 11/1966 | Jacobs | |
| 3,288,156 | A | | 11/1966 | Jordan et al. | |
| 3,292,645 | A | | 12/1966 | Braden et al. | |
| 3,348,775 | A | | 10/1967 | Flame | |
| 3,809,106 | A | | 5/1974 | Crabtree | |
| 3,912,797 | A | * | 10/1975 | Boler et al. | 261/90 |
| 4,014,467 | A | * | 3/1977 | Ferguson | 239/261 |
| 4,208,359 | A | * | 6/1980 | Bugler et al. | 261/111 |
| 5,755,244 | A | * | 5/1998 | Sargeant et al. | 134/46 |
| 6,244,277 | B1 | * | 6/2001 | Maunsell | 134/60 |
| 6,260,565 | B1 | | 7/2001 | Welch et al. | |
| 6,460,555 | B1 | | 10/2002 | Tuller et al. | |
| 6,491,049 | B1 | | 12/2002 | Tuller et al. | |
| 6,869,029 | B2 | | 3/2005 | Ochoa, Sr. et al. | |
| 2003/0183255 | A1 | * | 10/2003 | Kim et al. | 134/198 |
| 2004/0255982 | A1 | * | 12/2004 | VanderRoest et al. | 134/25.2 |
| 2004/0255988 | A1 | * | 12/2004 | DuHack et al. | 134/57 D |
| 2005/0066998 | A1 | | 3/2005 | Palm et al. | |
| 2005/0133070 | A1 | | 6/2005 | Vanderroest et al. | |
| 2005/0150529 | A1 | | 7/2005 | Vanderroest et al. | |

FOREIGN PATENT DOCUMENTS

| | | | |
|---|---|---|---|
| FR | 1335909 | * | 10/1962 |

* cited by examiner

WASH/RINSE SYSTEM FOR A DRAWER-TYPE DISHWASHER

CROSS-REFERENCE TO RELATED APPLICATION

The present application claims the benefit of U.S. Provisional Patent Application Ser. No. 60/793,245 filed Apr. 20, 2006 entitled "Wash/Rinse System For a Drawer-Type Dishwasher."

BACKGROUND OF THE INVENTION

1. Field of the Invention

The present invention pertains to the art of dishwashers and, more particularly, to a wash/rinse system for a drawer-type dishwasher.

2. Discussion of the Prior Art

Drawer-type dishwashers are widely known in the art and, once again, gaining popularity with consumers. Typically, a drawer-type dishwasher will include a drawer or washing tub that is slidably mounted in a cabinet. A dish rack is provided within the washing tub to support dishware and the like during a washing operation. In any event, various models of drawer-type dishwasher are available to today's consumers. The dishwasher can range from a single drawer unit to multi-compartment units that are arranged in upper and lower or side-by-side configurations. The multi-compartment units include either multiple drawers or, a combined drawer and conventional type dishwasher. However, regardless of the particular configuration, a drawer-type dishwasher includes a lid that selectively seals the washing tub during a wash operation.

During the washing operation, washing fluid is sprayed onto kitchenware and the like situated in the washing tub. The washing fluid is directed from a lower wash arm and, often times, from a wash arm mounted to the lid. In this manner, the manufacturer ensures that all of the kitchenware is exposed to jets of washing fluid during the washing operation. While effective at establishing a more uniform distribution of washing fluid, upper or lid mounted wash arms are prone to leak or drip water onto internal dishwasher components when the drawer is withdrawn from the cabinet. Water dripping onto internal machine components can cause erosion problems that may ultimately create maintenance or premature failure issues for the consumer.

Thus, based on the above, there still exists a need in the art for a drawer-type dishwasher that includes a wash/rinse system that directs sprays of washing fluid into upper portions of a washing chamber wherein, when the drawer is removed for unloading/loading dishwasher, washing fluid does not drip onto internal dishwasher components.

SUMMARY OF THE INVENTION

The present invention is directed to a wash/rinse system for a drawer-type dishwasher including an outer support body, a drawer slidingly received in the outer support body having front, rear, bottom and opposing side walls that collectively define a washing chamber, a lid shiftably mounted in the outer support body for selectively closing the washing chamber, and a dishrack positioned in the washing chamber for supporting articles to be exposed to a washing operation. In accordance with the invention, the wash/rinse system includes a wash mechanism having a paddlewheel provided with at least one deflector member and a spray bar. The spray bar is provided with at least one nozzle and is mounted in the washing chamber adjacent the paddlewheel.

In further accordance with the invention, the at least one nozzle is positioned so as to deliver a jet of washing fluid onto the at least one deflector member in order to impart a rotational force to the paddlewheel. Upon impacting the at least one deflector member, the jet of washing fluid diverges into a stream(s) of washing fluid which is sprayed onto articles supported in the washing chamber during the washing operation. Preferably, the spray bar includes a plurality of nozzles which direct multiple jets of washing fluid onto a corresponding plurality of deflector members.

In the most preferred form of the invention, the paddlewheel is mounted at an upper portion of the back wall of the washing chamber, with the plurality of deflector members being positioned at various angles or orientations so as to create random streams of washing fluid that are sprayed about the washing chamber. In this manner, the random streams of washing fluid combine with washing fluid emanating from a lower wash arm to clean the articles supported upon the rack.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENT

Figure 1:
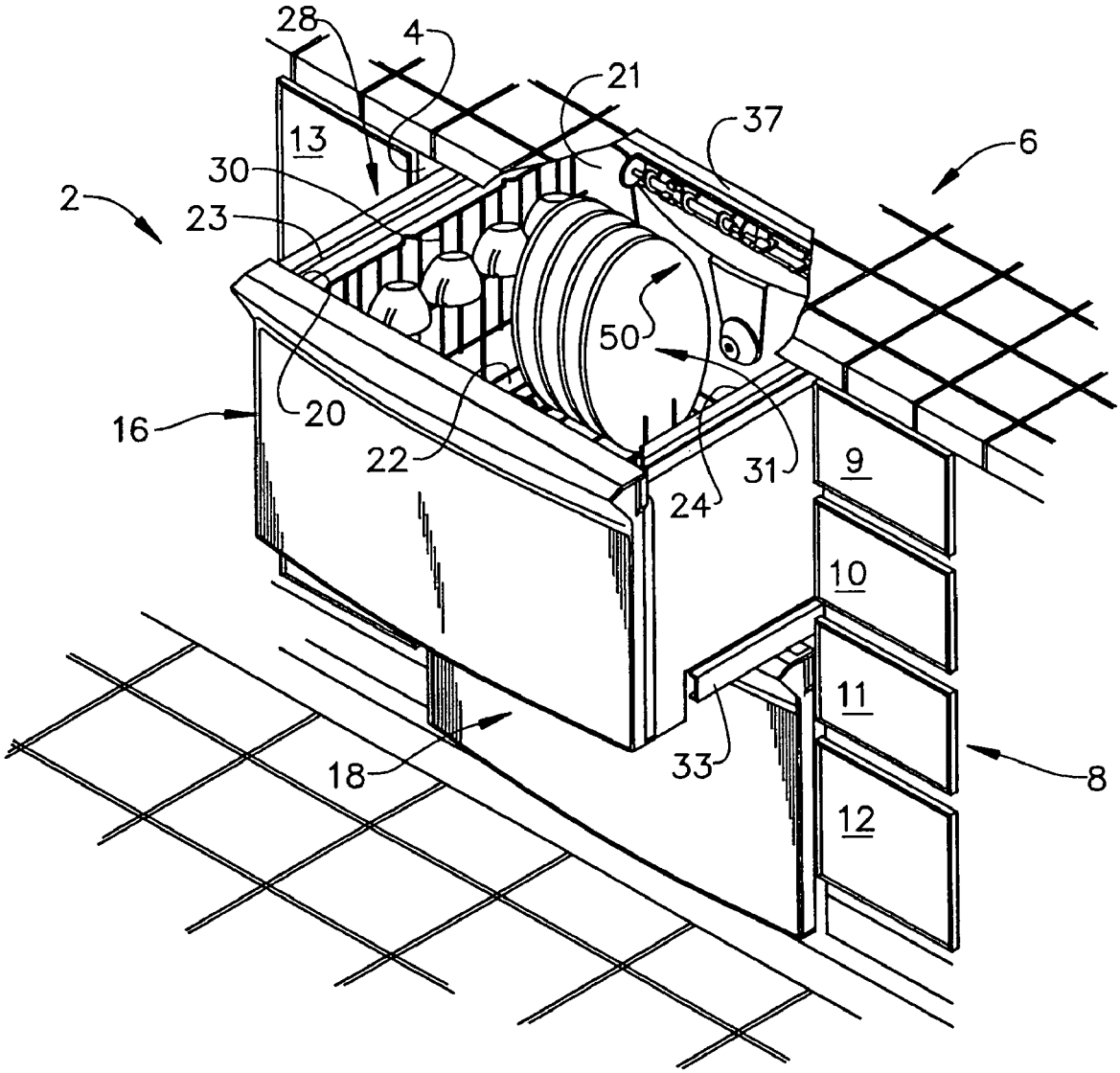
FIG. 1 is an upper right perspective view of a drawer-type dishwasher incorporating a wash/rinse system constructed in accordance with the present invention.
Figure 2:
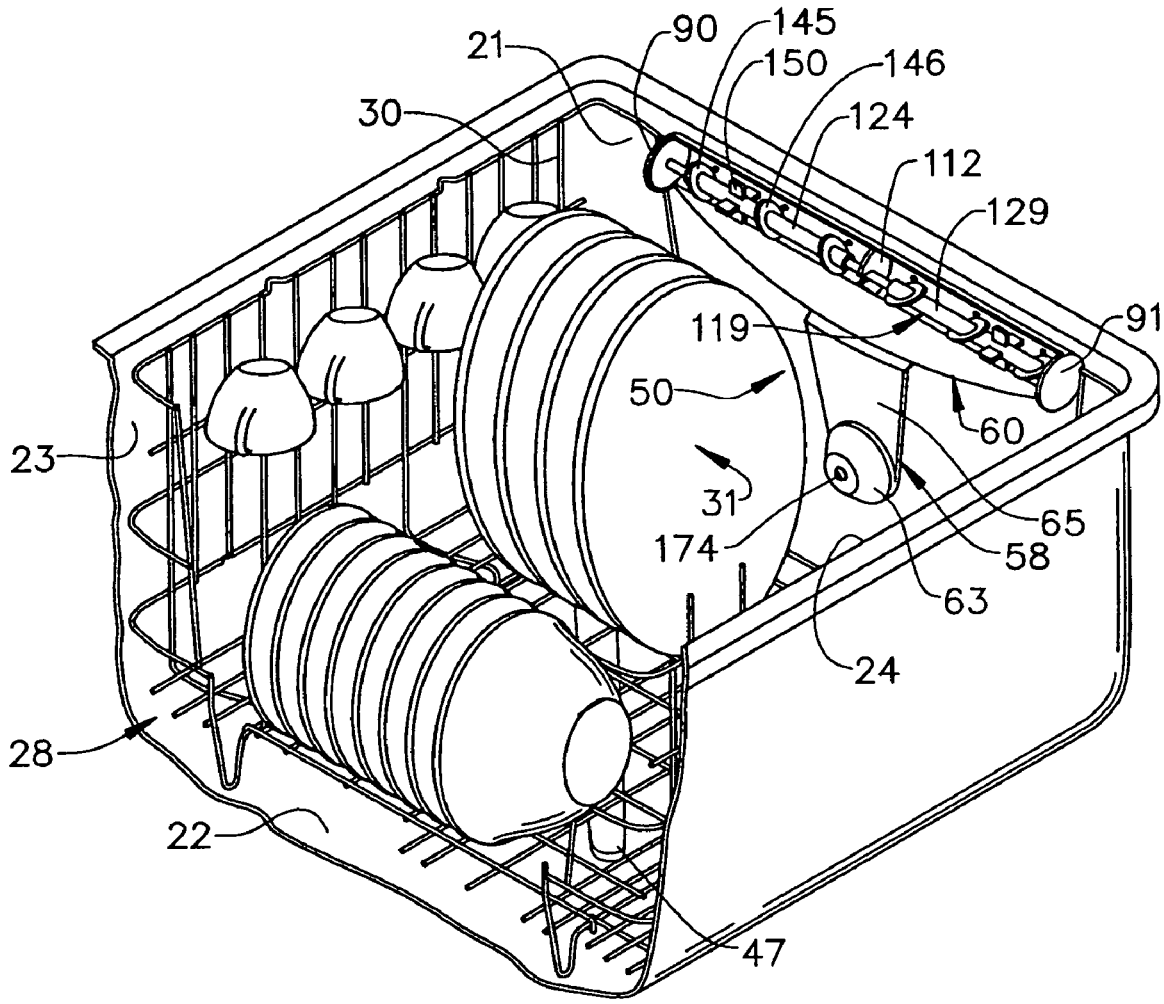
FIG. 2 is an upper right, partially cut-away perspective view of a drawer portion of the dishwasher of FIG. 1 illustrating the wash/rinse system mounted in accordance with the present invention.

With initial reference to FIGS. 1 and 2, a dishwasher constructed in accordance with the present invention, is generally indicated at 2. Dishwasher 2 includes an outer support body 4 which is positioned below a kitchen countertop 6 along side a plurality of cabinets 8. As shown, cabinets 8 include drawers 9-12 and a door 13. As further shown, dishwasher 2 includes an upper washing unit or drawer 16, as well as a lower washing unit or drawer 18. As each washing unit 16, 18 is similarly constructed, a detailed description will be made with respect to upper washing unit 16 with an understanding that lower washing unit 18 includes corresponding structure.

Upper washing unit 16 includes a front wall 20, a rear wall 21, a bottom wall 22 and opposing side walls 23 and 24 that collectively define an upper washing chamber 28. A dishrack 30 is positioned within upper washing chamber 28 to support kitchenware, indicated generally at 31, which may include plates, cups or the like. Upper washing unit 16 is slidably supported within outer support body 4 through a pair of extensible drawer glides, one of which is indicated at 33. Finally, dishwasher 2 is shown to include a lid 37 that is selectively shiftable relative to washing chamber 28 as drawer 16 is moved into and out of outer support body 4.

Figure 3:
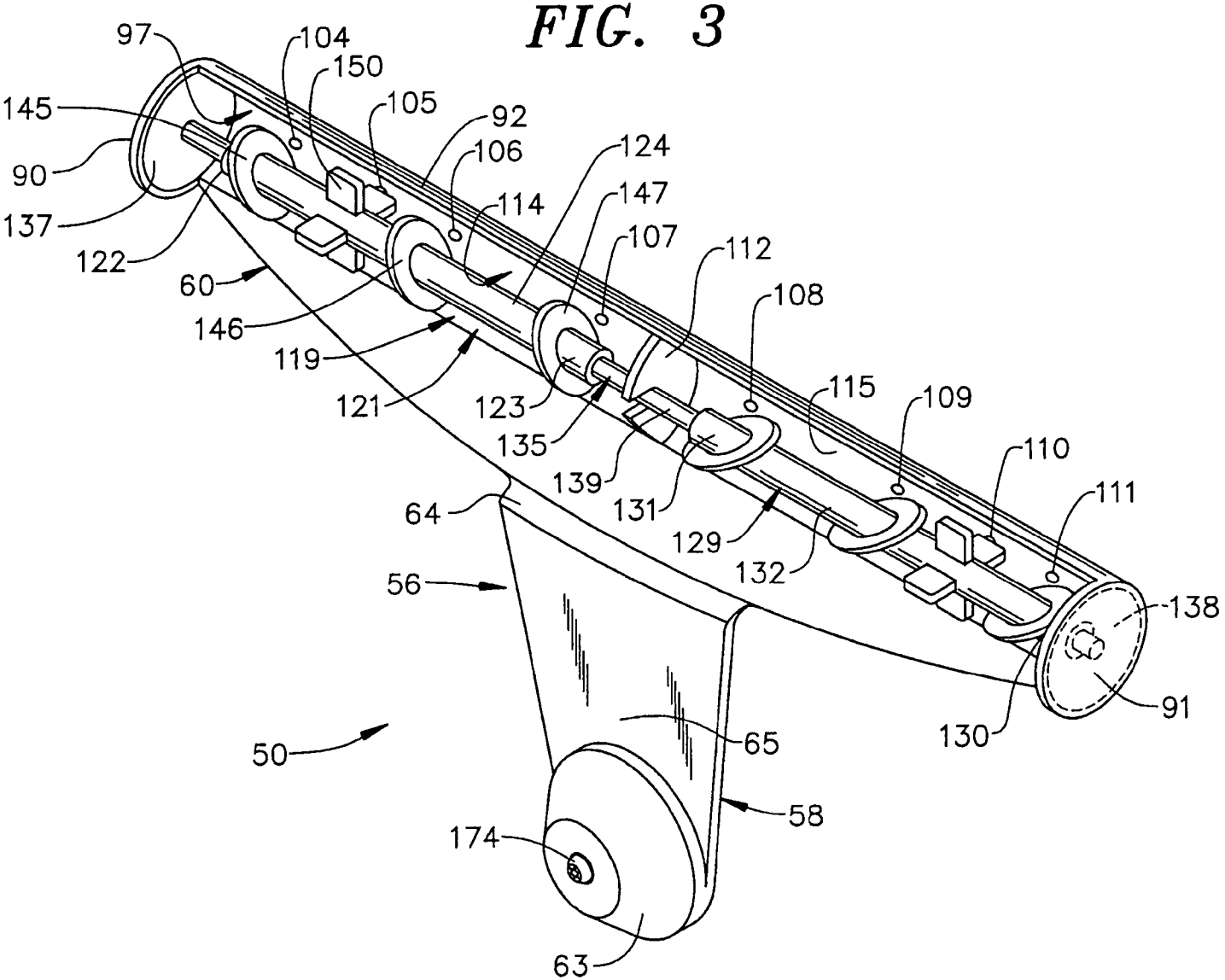
FIG. 3 is an upper right perspective view of the wash/rinse system of FIG. 2.

Dishwasher 2 selectively performs a washing operation in washing chamber 28 during which sprays or jets of washing fluid are directed onto kitchenware 31 by a lower wash arm 47, as well as an upper washing mechanism 50. In the embodiment shown, upper washing mechanism 50 is positioned at an upper portion of rear wall 21. As best shown in FIGS. 2 and 3, upper washing mechanism 50 includes a water delivery portion 56 having an inlet conduit 58 which directs a flow of washing fluid towards a spray bar 60. In accordance with the invention, inlet conduit 58 includes a first end section 63 that extends to a second end section 64 through an intermediate section 65. First end section 63 is preferably domed-shaped so as to receive an inlet nozzle 69 therein (see FIG. 4) as will be discussed more fully below.

As further shown in FIG. 3, spray bar 60 includes a first end portion 90 that extends to a second end portion 91 through an intermediate portion 92 that defines a central trough 97. First and second end portions 90 and 91 actually define support members in a manner that will be detailed more fully below. In any event, spray bar 60 is actually fluidly connected to second end section 64 of inlet conduit 58 so as to receive a flow of washing fluid from inlet nozzle 69. The flow of washing fluid is directed outward from central trough 97 through a plurality of nozzles 104-111. Actually, trough 97 is divided into first and second lateral sections or zones 114 and 115 by a central support member 112, with nozzles 104-107 being positioned in first lateral zone 114 and nozzles 108-111 being positioned in second lateral zone 115.

Upper washing mechanism 50 also includes a paddlewheel member 119 rotatably supported within trough 97 of spray bar 60. Paddlewheel member 119 actually includes a first paddle support 121 having a first end section 122 that extends to a second end section 123 through an intermediate section 124. First paddle support 121 is arranged within first lateral zone 114 of trough 97. Arranged alongside first paddle support 121, in second lateral zone 115, is a second paddle support 129. In a manner similar to that described above, second paddle support 129 includes a first end section 130, a second end section 131 and an intermediate section 132. First and second paddle supports 121 and 129 are rotatably supported upon a central rod 135 that extends substantially the entire length of trough 97. Towards that end, central rod 135 includes first and second outer bearing elements 137 and 138 that are rotatably supported upon first and second end sections 90 and 91 of spray bar 60, as well as a central bearing/support portion 139 that rests upon central support member 112. In any case, as each paddle support 121, 129 is substantially, identically constructed, a detailed description will be made with respect to first paddle support 121 with an understanding that second paddle support 129 is correspondingly constructed.

First paddle support 121 includes a plurality of disk-shaped deflector members 145-147 positioned adjacent nozzles 104, 106 and 107 respectively, as well as a paddle-shaped deflector member 150 positioned adjacent to nozzle 105. With this arrangement, a jet of washing fluid exiting nozzle 105 impacts paddle-shaped deflector member 150 causing first paddle support 121 to rotate about an axis defined by central rod 135. As first paddle support 121 rotates, additional jets of washing fluid emanating from nozzles 104, 106 and 107 impact disk-shaped deflector members 145-147 respectively, causing the jets of washing fluid to diverge into streams of washing fluid which are directed onto kitchenware supported upon dishrack 30.

Figure 4:
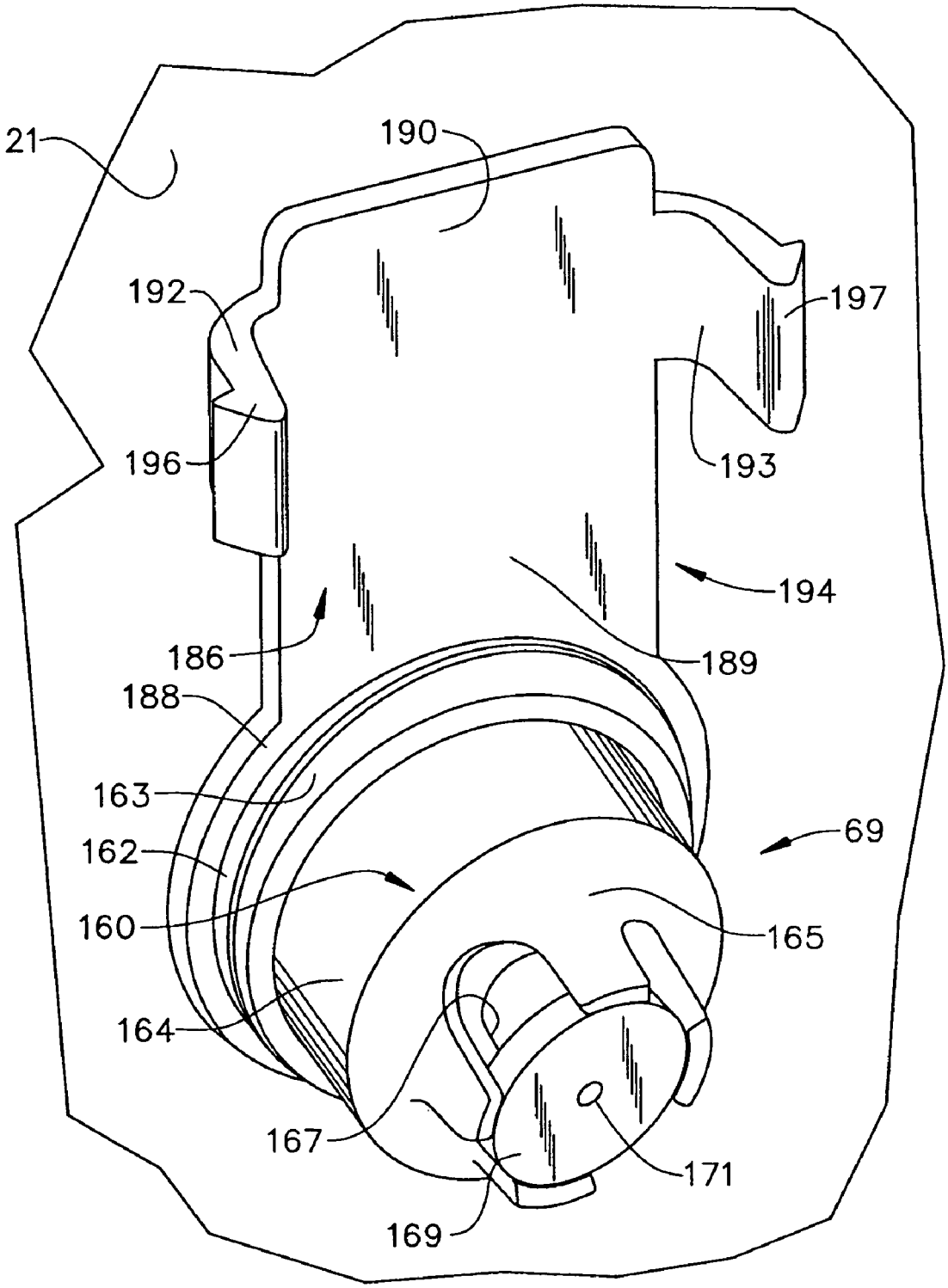
FIG. 4 is a perspective view of an inlet nozzle portion of the wash/rinse system.

As discussed above, washing fluid is introduced into upper washing mechanism 50 through inlet nozzle 69 illustrated in FIG. 4. In accordance with the invention, inlet nozzle 69 includes a main body portion 160 having a base section 162, provided with a circular flange 163, which extends through an intermediate section 164 to a tapered or nozzle section 165. Nozzle section 165 is provided with a plurality of openings, one of which is indicated at 167, as well as a diffuser 169. Diffuser 169 includes an aperture 171 that receives a mechanical fastener 174 (see FIG. 3) which secures upper washing mechanism 50 to washing chamber 28. In addition to mechanical fastener 174, upper washing mechanism 50 is also retained against rear wall 21 by a mounting bracket 184.

In further accordance with the invention, mounting bracket 184 includes a main body 186 having a ring portion 188 from which extends an intermediate or planar portion 189 before terminating in a support portion 190. Support portion 190 includes first and second ear elements 192 and 193, each provided with a corresponding tab element 196, 197 that snap-fittingly engages inlet conduit 58. As will be discussed more fully below, mounting bracket 184 is secured against rear wall 21 of washing chamber 28 through circular flange 163 of inlet nozzle 69.

Figure 5:
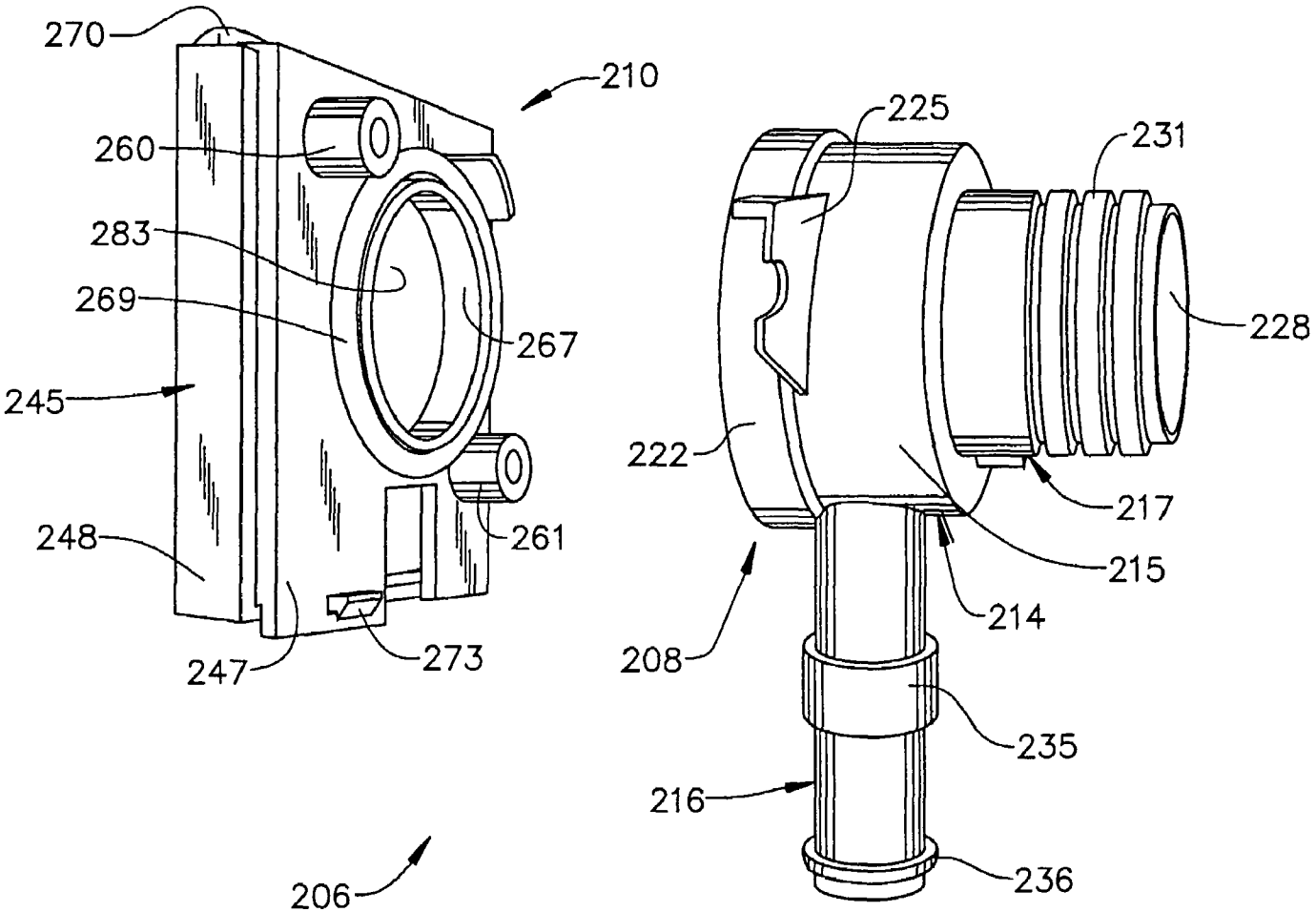
FIG. 5 is an exploded view of a feed member portion of the wash/rinse system.
Figure 6:
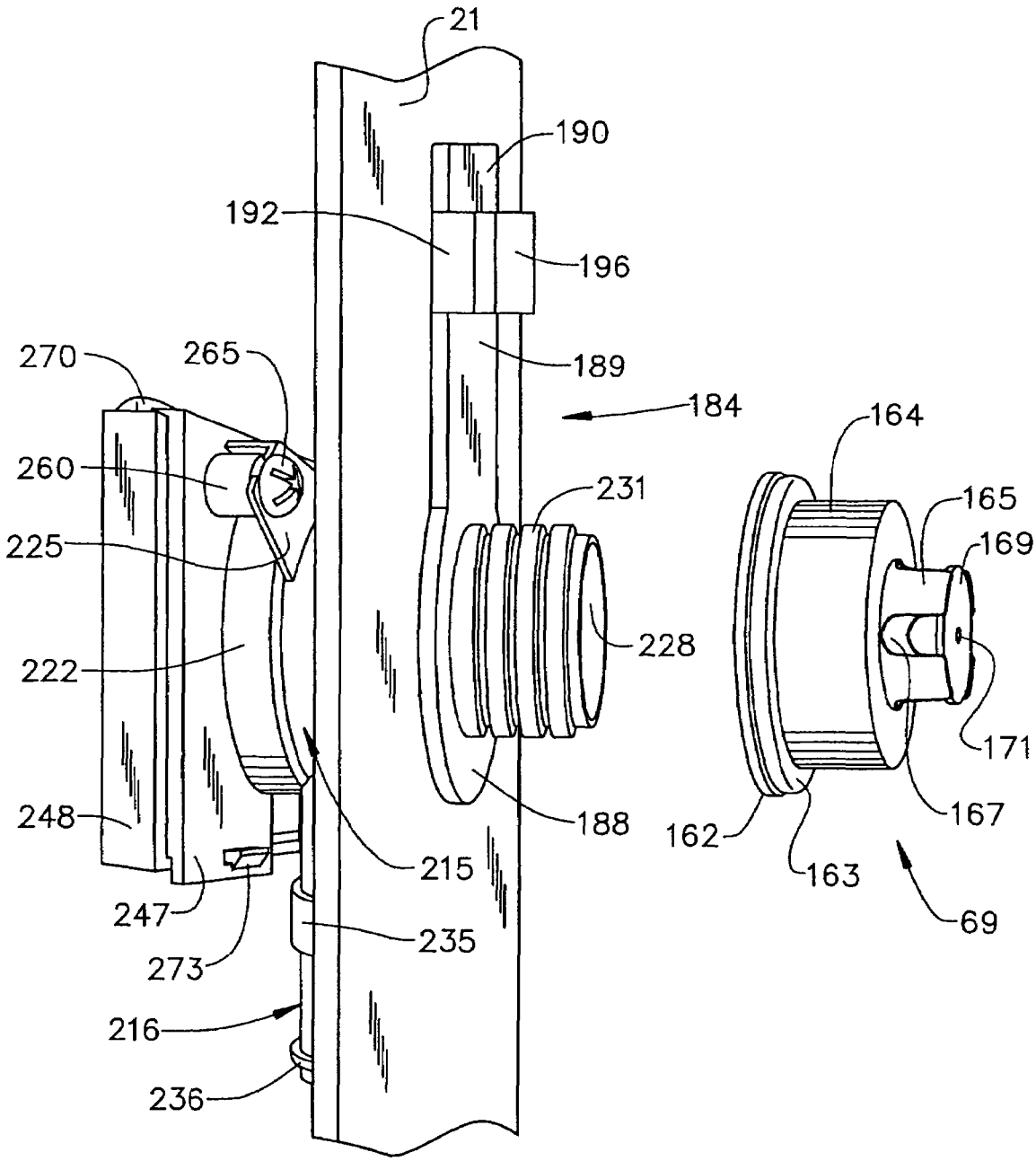
FIG. 6 is a perspective view of the inlet nozzle of FIG. 4 being attached to the feed member of FIG. 5 at a rear wall of the wash chamber.

As best shown in FIGS. 5 and 6, inlet nozzle 69 is connected to and receives a flow of washing fluid through an inlet feed member 206 extending through rear wall 21 of washing chamber 28. Inlet feed member 206 includes a conduit portion 208 and a base portion 210. Conduit portion 208 includes a main body section 214 having a base section 215 from which extend an inlet nipple 216 and an outlet nipple 217. Main body section 214 also includes a flange 222 having a pair of mounting ears, one of which is indicated at 225. As will be discussed more fully below, flange 222 acts as an interface between conduit portion 208 and base portion 210.

Figure 7:
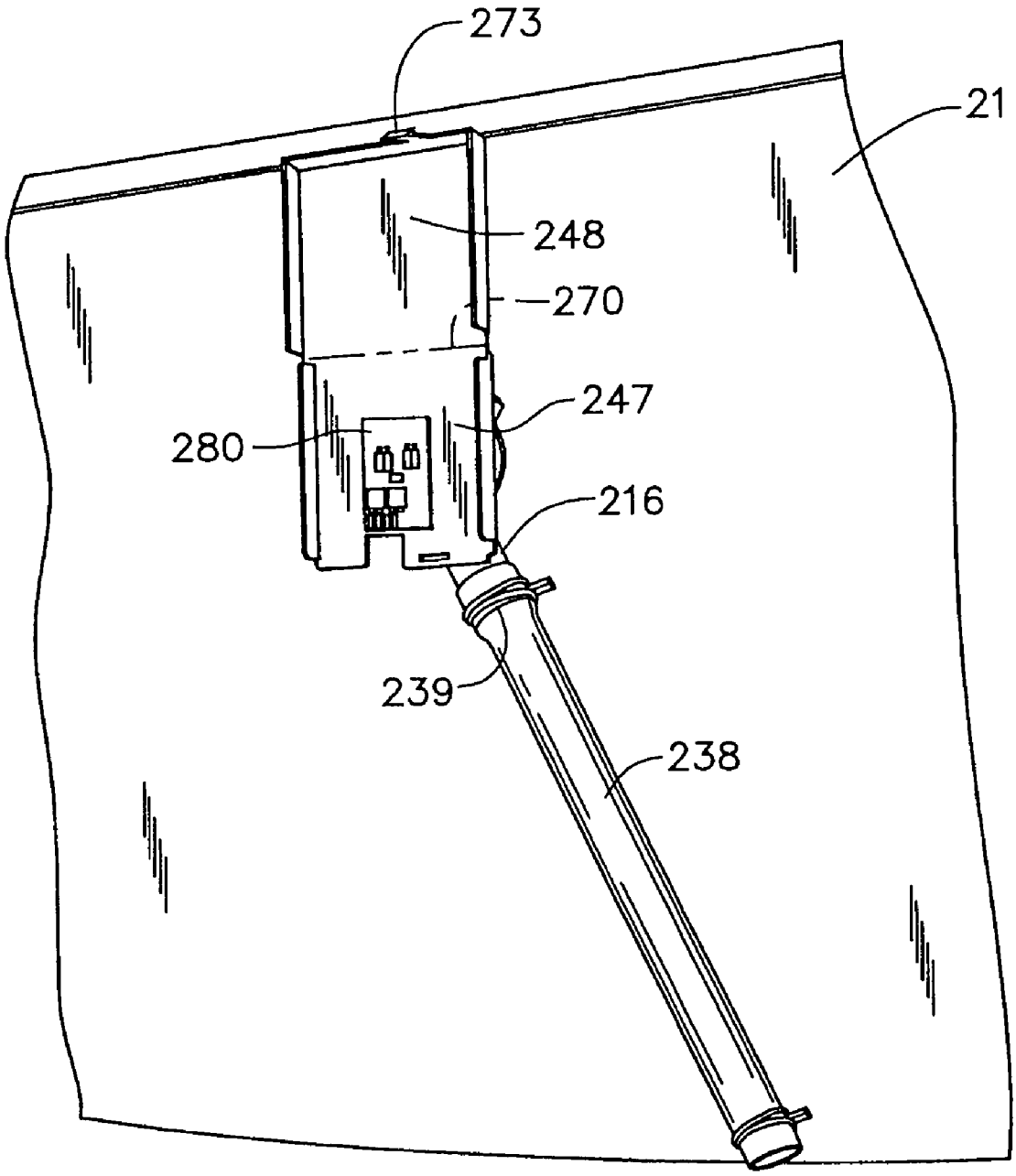
FIG. 7 is a rear view of the washing chamber of FIG. 2 illustrating a flow sensor mounted in accordance with the present invention.

Outlet nipple 217 includes a hollow interior portion 228 that leads into base section 215 and fluidly connects to inlet nipple 216. Outlet nipple 217 also includes a plurality of external threads 231 which, as best shown in FIG. 6, engage with inlet nozzle 69. More specifically, outlet nipple 217 extends through rear wall 21 of washing chamber 28 and ring portion 188 of mounting bracket 184. Once in place, inlet nozzle 69 is secured to inlet feed member 206 through threads 231, with circular flange 163 trapping mounting bracket 184 against rear wall 21. Finally, inlet nipple 217 is shown to include a pair of outer rings 235 and 236 which provide a positive engagement for a hose 238 that is secured through a clamp 239 (see FIG. 7). With this arrangement, inlet feed member 206 receives a flow of washing fluid from a pump (not shown) through inlet nipple 216. The flow of washing fluid is thereafter redirected outward through outlet nipple 217 into inlet nozzle 69 and into spray bar 60.

As stated above, conduit portion 208 is supported upon a base portion 210 through flange 222. Towards that end, base member 210 is provided with a main housing 245 that includes a mounting member 247 and a cover 248. Mounting member 247 is provided with a pair of supports 260 and 261 that align with mounting ears 225. Supports 260 and 261 are adapted to receive mechanical fasteners, one of which is shown at 265, to secure conduit portion 208 to base portion 210. Mounting member 247 further includes a central opening 267 that leads into main housing 245. A seal 269 extends about central opening 267 and engages with flange 222 of conduit portion 208. In addition, cover 248 is pivotally connected to mounting member 247 through a hinge 270 and secured through a tab member 273. Actually, main housing 245 serves as an enclosure for electronic circuitry 280 (see FIG. 7) associated with a flow sensor 283, such as a diaphragm positioned across central opening 267. Sensor 283 senses the flow of washing fluid through conduit portion 208 during an overall washing operation.

Figure 8:
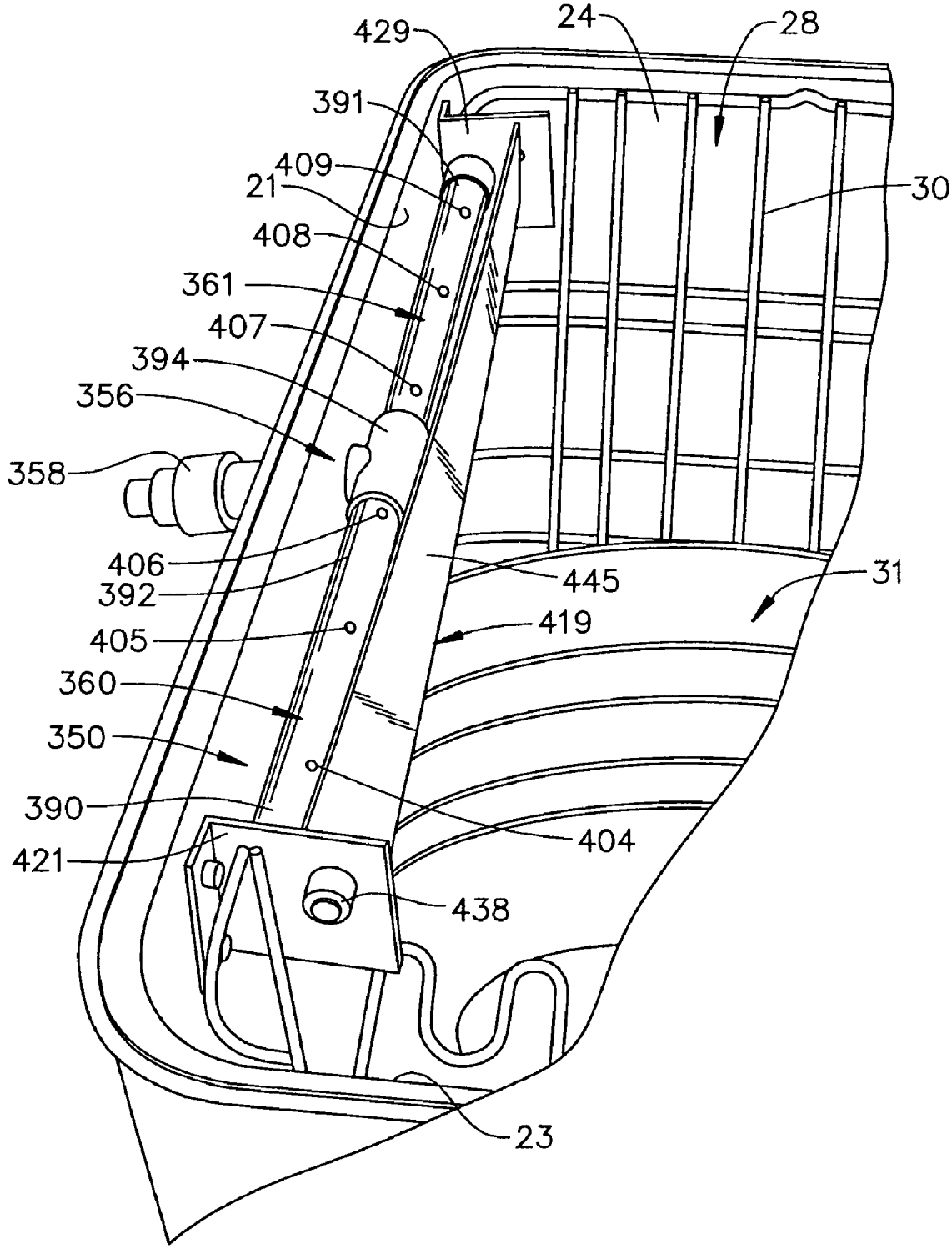
FIG. 8 is a wash/rinse system constructed in accordance with an alternative embodiment of the present invention.

Reference will now be made to FIG. 8 in describing an alternative embodiment of the present invention. As shown, an upper wash mechanism 350 includes a water delivery portion 356 having an inlet conduit 358 that is connected to a spray bar 360. Spray bar 360 includes a first end section 390 that extends to a second end section 391 through an intermediate section 392. Actually, arranged at intermediate section 392 is a "T" member 394 that directs a flow of washing fluid into a first lateral zone 360 and a second lateral zone 361. Each lateral zone 360, 361 includes a plurality of nozzles 404-406 and 407-409 respectively. Jets of washing fluid emanating from nozzles 404-409 impact upon a paddlewheel member 419 that is rotatably mounted to a pair of laterally spaced first and second support members 421 and 429. Actually, paddlewheel member 419 is provided with a pair of bearings, one of which is indicated at 438, that provide smooth rotation as paddlewheel 419 is impacted and rotated by jets of washing fluid emanating from nozzles 404-409. In addition, paddlewheel member 419 is provided with a slight twist or spiral which ensures continued exposure to the jets of washing fluid. Thus, in accordance with the embodiment shown, paddlewheel member 419 constitutes an overall deflector member 445 that causes the jets of washing fluid to diverge into a plurality of streams which subsequently impact upon kitchenware supported upon dishrack 30 during an overall washing operation.

At this point, it should be readily understood that the present invention provides for an efficient upper washing mechanism for directing water to an upper portion of a washing chamber in a drawer-type dishwasher. More particularly, mounting the upper washing mechanism to a wall of the wash chamber advantageously provides protection to various wash system components arranged within outer housing 4. More specifically, the particular positioning of the upper washing mechanism ensures that any residual water remaining within the wash system drops directly into the washing chamber and not onto various components carried within outer housing 4 as would be the case with a wash arm mounted to, for example, lid 37. In addition, the paddlewheel configuration establishes an extremely efficient and effective washing fluid distribution arrangement that creates streams of washing fluid sprayed randomly about the washing chamber. In any case, although described with reference to preferred embodiments of the invention, it should be readily understood that various changes and/or modifications can be made to the invention without departing from the spirit thereof. For instance, the overall shape, angular orientation, number and spacing of the deflector members can vary in accordance with the present invention. In general, the invention is only intended to be limited by the scope of the following claims.

We claim:

1. A dishwasher comprising:

an outer support body;

a drawer slidingly received in the outer support body, said drawer including front, rear, bottom and opposing side walls that collectively define a washing chamber;

a lid shiftably mounted in the outer support body for selectively closing the washing chamber;

a dishrack positioned in the washing chamber for supporting articles to be exposed to a washing operation;

a paddlewheel including multiple deflector members spaced along a longitudinal axis of the paddlewheel, the paddlewheel being rotatably mounted in the washing chamber at an upper portion of the rear wall, wherein the multiple deflector members include at least one fluid diverging deflector member and at least one paddle deflector member; and a spray bar mounted adjacent the paddlewheel in the washing chamber, the spray bar including a plurality of nozzles adapted to direct jets of washing fluid onto the at least one paddle deflector member to impart a rotational force to the paddlewheel, and onto the at least one fluid diverging deflector member causing, said jets of washing fluid to diverge into multiple streams of washing fluid which are sprayed randomly about the washing chamber during the washing operation.

2. The dishwasher according to claim 1, wherein the spray bar is divided into first and second laterally spaced zones.

3. The dishwasher according to claim 2, wherein the paddlewheel includes a first end section, a second end section and an intermediate section, each of said first and second end portions being rotatably attached to corresponding first and second, spaced support members.

4. The dishwasher according to claim 3, wherein the spray bar includes a first end portion, a second end portion and an intermediate portion, said intermediate portion being constituted by a trough that extends between the first and second lateral zones.

5. The dishwasher according to claim 4, wherein the first and second lateral zones are separated by a support member, said paddlewheel being rotatably secured between the first and second end portion and supported by the support member.

6. The dishwasher according to claim 3, wherein the spray bar includes an inlet portion that is fluidly connected to the plurality of nozzles, said inlet portion being adapted to receive a flow of washing fluid.

7. The dishwasher according to claim 1, wherein the paddle wheel includes first and second paddle supports, each paddle support including multiple deflector members.

8. The dishwasher according to claim 7, wherein the first paddle support is positioned in the first lateral zone of the spray bar and the second paddle support is positioned in the second lateral zone of the spray bar.

9. A dishwasher comprising:

an outer support body;

a drawer slidingly received in the outer support body, said drawer including front, rear, bottom and opposing side walls that collectively define a washing chamber;

a lid shiftably mounted in the outer support body for selectively closing the washing chamber;

a dishrack positioned in the washing chamber for supporting articles to be exposed to a washing operation;

a paddlewheel including multiple deflector members rotatably mounted in the washing chamber, wherein the paddlewheel includes a first end section, a second end section and an intermediate section, each of said first and second end portions being rotatably attached to corresponding first and second support members, and wherein the multiple deflector members include disc-shaped deflector members and paddle deflector members; and a spray bar including at least one nozzle mounted adjacent the paddlewheel in the washing chamber and being divided into first and second laterally spaced zones, said at least one nozzle delivering a jet of washing fluid onto the disc-shaped and paddle deflector member and imparting a rotational force to the paddlewheel, wherein upon impacting the disc-shaped and paddle deflector members, said jet of washing fluid diverges into at least one stream of washing fluid which is sprayed randomly about the washing chamber during the washing operation.

10. The dishwasher according to claim 9, wherein the spray bar and the paddlewheel are mounted to an upper portion of the rear wall of the washing chamber.

11. The dishwasher according to claim 9, wherein the paddle wheel includes first and second paddle supports, each paddle support including both disc-shaped and paddle deflector members.

12. The dishwasher according to claim 11 wherein, on each of the first and second paddle supports, a paddle deflector member is positioned between two disc-shaped deflector members.

13. The dishwasher according to claim 12, wherein the paddlewheel includes a central rod, each of the first and second paddle supports being rotatably mounted on the central rod.

14. The dishwasher according to claim 11, wherein the first paddle support is positioned in the first lateral zone of the spray bar and the second paddle support is positioned in the second lateral zone of the spray bar.

15. A dishwasher comprising:

an outer support body;

a drawer slidingly received in the outer support body, said drawer including front, rear, bottom and opposing side walls that collectively define a washing chamber;

a lid shiftably mounted in the outer support body for selectively closing the washing chamber;

a dishrack positioned in the washing chamber for supporting articles to be exposed to a washing operation;

a paddlewheel including at least one deflector member rotatably mounted in the washing chamber, wherein the paddlewheel includes a first end section, a second end section and an intermediate section, each of said first and second end portions being rotatably attached to corresponding first and second support members;

a spray bar including at least one nozzle mounted adjacent the paddlewheel in the washing chamber and being divided into first and second laterally spaced zones, said at least one nozzle delivering a jet of washing fluid onto the at least one deflector member and imparting a rotational force to the paddlewheel, said spray bar including an inlet portion that is fluidly connected to the at least one nozzle, said inlet portion being adapted to receive a flow of washing fluid, wherein upon impacting the at least one deflector member, said jet of washing fluid diverges into at least one stream of washing fluid which is sprayed randomly about the washing chamber during the washing operation; and an inlet nozzle fluidly connected to the inlet portion and adapted to supply fluid to the inlet portion, said inlet nozzle including a main body portion having a base section that extends to a nozzle section, said nozzle section including a diffuser.

16. The dishwasher according to claim 15, further comprising: an inlet feed member fluidly connected to the inlet nozzle through one of the walls of the washing chamber, said inlet feed member including a conduit portion and a base portion.

17. The dishwasher according to claim 16, wherein the conduit portion includes an inlet nipple and an outlet nipple, said outlet nipple being provided with a plurality of threads adapted to engage with the inlet nozzle.

18. The dishwasher according to claim 17, wherein the base portion includes a flow sensor that senses a flow of washing fluid passing from the inlet nipple to the outlet nipple.

19. The dishwasher according to claim 16, wherein the inlet nozzle further includes a support portion extending from the base section, said conduit portion being snap-fittingly connected to the inlet nozzle at the support portion.

* * * * *